US005527212A

United States Patent [19]

Bowen et al.

[11] Patent Number: 5,527,212

[45] Date of Patent: Jun. 18, 1996

[54] BOWEN/NORTON DUSTLESS SANDING DEVICE

[76] Inventors: Hugh Bowen, 17202 Via Flores, San Lorenzo, Calif. 94580; Derald N. Norton, 204 92nd St., Daly City, Calif. 94015

[21] Appl. No.: 245,973

[22] Filed: May 19, 1994

[51] Int. Cl.[6] ..... B24B 23/00; B24B 55/10

[52] U.S. Cl. ..... 451/456; 451/356

[58] Field of Search ..... 451/344, 351, 451/354, 356, 456

[56] References Cited

U.S. PATENT DOCUMENTS

| | | | |
|---|---|---|---|
| 3,793,781 | 2/1974 | Hutchins | 451/356 |
| 4,062,152 | 12/1977 | Mehrer | 451/344 |
| 4,697,389 | 10/1987 | Romine | 451/456 |
| 4,937,984 | 7/1990 | Taranto | 451/456 |
| 4,964,243 | 10/1990 | Reiter | 451/456 |

OTHER PUBLICATIONS

Front and back side of "Vacuum Drywall Sander" package by PermaGlas–Mesh Inc.

*Primary Examiner*—Bruce M. Kisliuk
*Assistant Examiner*—Eileen P. Morgan
*Attorney, Agent, or Firm*—Jack Lo

[57] ABSTRACT

A dustless sanding device includes a base with a hollow chamber and a top opening. Bottom and side inlets communicating with the chamber are arranged on a bottom and sides, respectively, of the base. A pair of spaced apart hollow brackets extend upwardly from a rotating member rotatably positioned within the top opening, and communicate with the chamber through the rotating member. A T-shaped hollow air connector has a transverse portion rotatably positioned between the brackets and in communication therewith. A pair of Wing Nuts at the ends of the base secure a porous sanding screen wrapped around the bottom of the base. A vacuum cleaner can be attached to the air connector for extracting sanding dust produced during the sanding process through the sanding screen.

4 Claims, 2 Drawing Sheets

BOWEN/NORTON DUSTLESS SANDING DEVICE

BACKGROUND OF THE INVENTION

1. Field of The Invention:

This invention relates generally to sanding devices, specifically to a dustless sanding device.

2. Prior Art:

In a variety of sanding and abrading activities, most notably those in the construction field, airborne particles or dust are produced in the process. Such sanding dust is inhaled by workers through their mouths and noses, and settle onto their eyes, so that it causes significant health problems. The sanding dust also settle around the work area so as to require tedious cleanup.

Many devices have been proposed to reduce the production of sanding dust. U.S. Pat. Nos. 4,937,984 to Taranto (1989); 4,964,243 to Reiter (1989); 5,007,206 to Paterson (1989); 5,036,627 to Walters (1989); 5,144,774 to Conboy (1990); and 5,193,311 to Sanchez (1991) show dustless sanding devices that each uses a highly porous sanding screen, which is typically positioned under the base, wrapped around the ends thereof, and secured on top by a wing nut or other clamping device. An air connector or tube on the back of the device is adapted to be fitted to a vacuum cleaner, which draws air and dust particles through the porous sanding screen. Some prior art dustless sanding devices have rigid air connectors, so that if they are extended with a hollow pole to reach high places, the tube must be held at a fixed angle, which makes using them very difficult. Other prior an dustless sanding devices employ a pivoted air connector movable within a range of angles, so that the sanding pad can be kept flat on a working surface. However, most such pivoted connectors are limited in their range of motions, and others use flexible hoses or boots that will bind and block air flow.

Another dustless sanding device is sold under the trademark "Vacuum Drywall Sander" by PermaGlas-Mesh Inc., Dover, Ohio. It uses a non-pivotable air connector, so that it is not suitable for use with a pole for reaching high place.

OBJECT OF THE INVENTION

Accordingly the primary object of the present invention is to provide a dustless sanding device that is attachable to a conventional vacuum cleaner to substantially reduce airborne sanding dust.

Another object of the present invention is to provide a dustless sanding device that can be attached to a hollow pole for reaching high places.

Another object of the present invention is to provide a dustless sanding device that provides a movable air connector with great freedom of movement.

Yet another object of the present invention is to provide a dustless sanding device that minimizes the need to lift it from a work surface, so that dust is further reduced.

Still another object of the present invention is to provide a dustless sanding device that will allow unrestricted airflow regardless of its position.

Further objects of the present invention will become apparent from a consideration of the drawings and ensuing description.

SUMMARY OF THE INVENTION

A dustless sanding device includes a flat base having a hollow chamber therein, and an air connector movably connected to the chamber. The connector is pivotable 360 degrees about an axis normal to the surface of the base. The air connector is adapted to be connected to a vacuum cleaner either directly or through a hollow pole. A conventional porous sanding screen is attached to the bottom of the base. When the vacuum cleaner is turned on, inlets on the bottom and side edges of the base draw in air and sanding dust through the sanding screen to substantially reduce airborne dust. The pivoting air connector allows the sanding device to be moved about on a working surface, such as a wall, while being kept flat thereon.

DRAWING REFERENCE NUMERALS

| | |
|---|---|
| 10. Base | 11. Top Opening |
| 12. Top Surface | 13. Side Inlets |
| 14. Side | 15. Side |
| 16. Porous Sanding Screen | 17. Bottom Surface |
| 18. Wing Nuts | 19. Rotating Member |
| 20. Hollow Brackets | 21. T-Shaped Air Connector |
| 22. Hollow Chamber | 23. Bottom Inlets On Base |
| 24. Retainers | 25. Transverse Portion |
| 26. Rubber Pad | 27. Holes In Rubber Pad |

DESCRIPTION—FIG. 1

Figure 1:
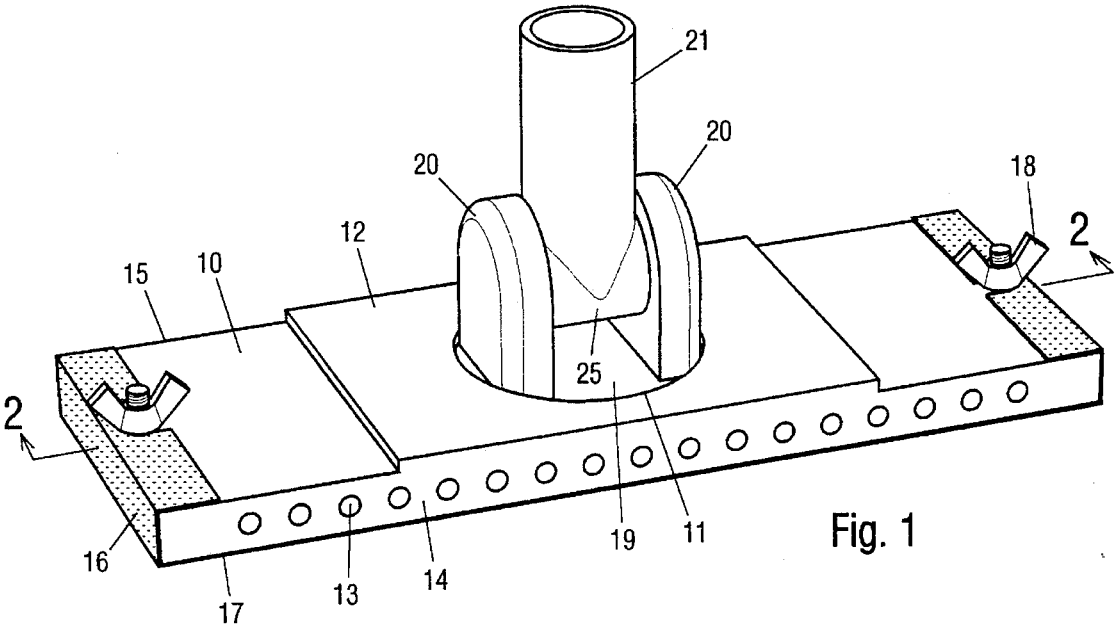
FIG. 1 is a side perspective view of a dustless sanding device in accordance with a preferred embodiment of the invention.

In accordance with a preferred embodiment of the invention shown in the side perspective view of FIG. 1, a dustless sanding device includes a flat base 10 with a circular top opening 11 on a top surface 12, and a series of side inlets 13 arranged along side edges 14 and 15 (inlets not shown on edge 15). A conventional, highly porous sanding screen 16 is positioned under a bottom surface 17 of base 10. The ends of sanding screen 16 are wrapped around the ends of base 10 and secured on top thereof by clamping means or wing nuts 18.

A rotating member 19 is rotatably positioned within top opening 11. A pair of spaced apart hollow brackets 20 extend upwardly from rotating member 19. A T-shaped hollow air connector 21 has a transverse portion 25 hingeably positioned between brackets 20. Air connector 21, brackets 20, and rotating member 19 are simultaneously rotatable within opening 11 360 degrees about an axis normal to base 10. Air connector 21 is rotatable between brackets 20 about another axis parallel to base 10.

DESCRIPTION—FIG. 2

Figure 2:
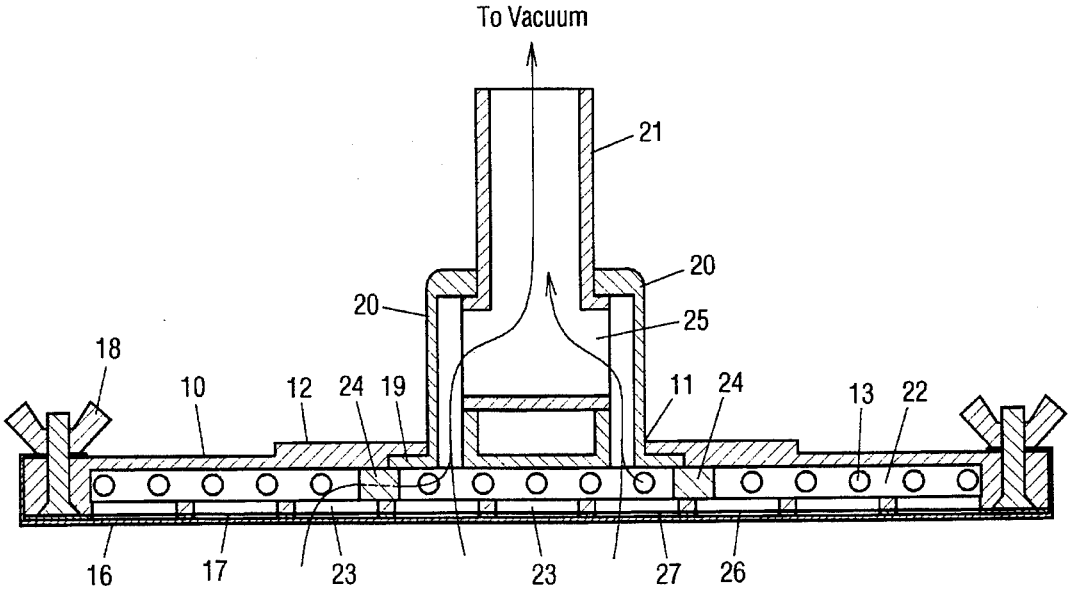
FIG. 2 is a side sectional view of the dustless sanding device taken along line 2—2 in FIG. 1.

As shown in the side sectional view of FIG. 2, base 10 includes a hollow chamber 22, and a series of bottom inlets 23 arranged on bottom surface 17. A rubber pad 26 is attached to bottom surface 17, and includes holes 27 in registration with bottom inlets 23, so that chamber 22 is in communication with sanding screen 16 through holes 27 and inlets 23. Side inlets 13 are in communication with chamber 22. Hollow brackets 20 allow communication between chamber 22 and air connector 21. A pair of retainers 24 engage the lower side of the rim of rotating member 19. Retainers 24 extend only partially across the width of base 10 so as to allow air to flow around them.

To use, air connector 21 may be attached directly to a conventional shop vacuum cleaner (not shown) for handheld use, or a conventional hollow pole (not shown) can be attached between air connector 21 and the vacuum cleaner for reaching high places. When the vacuum cleaner is turned on, air and sanding dust are drawn through porous sanding screen 16, holes 27, bottom inlets 23, hollow brackets 20, and air connector 21, so that airborne dust is substantially reduced or eliminated. Side inlets 13 extract dust produced around the edges of sanding screen 16. Pivotable air connector 21 allows the sanding device to be moved about on a work surface while being kept in full contact with it, regardless of its positioning, and provides unrestricted air flow for efficient dust removal.

DESCRIPTION—FIG. 3

Figure 3:
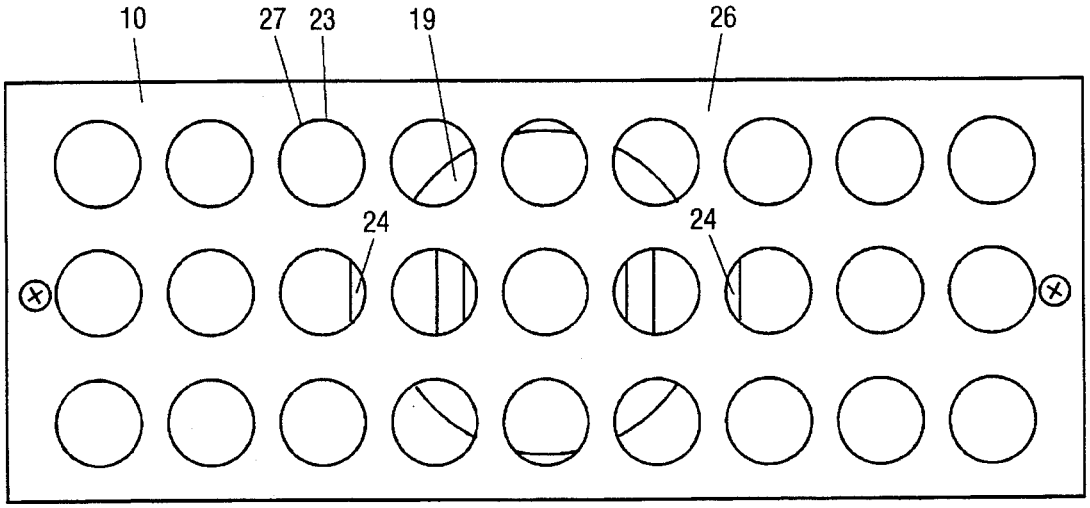
FIG. 3 is a bottom view of the dustless sanding device when a sanding screen is removed.

The dustless sanding device is shown in a bottom view in FIG. 3 without sanding screen 16 (FIG. 1). Numerous holes 27 on rubber pad 26 are in registration with bottom inlets 23 on bottom 17 (FIG. 2) of base 10 so as to allow maximum air flow.

SUMMARY, RAMIFICATIONS, AND SCOPE

Accordingly, we have provided a dustless sanding device that is attachable to a vacuum cleaner to reduce or eliminate sanding dust. It can be attached to a hollow pole for reaching high places. It can be moved about easily while being kept in full contact with the work surface regardless of its position. It requires a minimum of lifting from the work surface to further reduce dust production. It also provides unrestricted airflow regardless of its position.

Although the above descriptions are specific, they should not be considered as limitations on the scope of the invention, but only as examples of the embodiments. Many other ramifications and variations are possible within the teachings of the invention. Therefore, the scope of the invention should be determined by the appended claims and their legal equivalents, not by the examples given.

We claim:

1. A sanding device, comprising:

a flat base with top and bottom surfaces, a chamber arranged therein, a top opening arranged on said top surface, and a plurality of bottom air inlets arranged on said bottom surface and communicating with said chamber;

a rotating member rotatably positioned within said top opening of said base for rotation about an axis normal to said base;

a pair of spaced apart hollow brackets extending upwardly from said rotating member, said hollow brackets communicating with said chamber through said rotating member; and a T-shaped hollow air connector having a transverse portion rotatably positioned between said hollow brackets and communicating therewith, said air connector communicating with said chamber via said hollow brackets;

whereby a porous sanding means is attachable to said bottom surface of said base, and a vacuum means is attachable to a distal end of said air connector for drawing air in through said porous sanding means, said bottom inlets, said hollow brackets, and said air connector.

2. The sanding device of claim 1, further including clamping means adapted for clamping said porous sanding means to said base.

3. The sanding device of claim 2 wherein said clamping means comprises a pair of wing nuts arranged at opposite ends of said base.

4. The sanding device of claim 1, further including a plurality of side air inlets arranged along a side edge of said base and communicating with said chamber.

* * * * *